United States Patent [19]

Koenig et al.

[11] 4,296,283

[45] Oct. 20, 1981

[54] NORMALLY CLOSED WAFER SWITCH

[75] Inventors: Robert H. Koenig, Huntington Hills; Victor D'Angelo, Port Washington, both of N.Y.

[73] Assignee: Tapeswitch Corporation of America, Farmingdale, N.Y.

[21] Appl. No.: 39,807

[22] Filed: May 17, 1979

[51] Int. Cl.[3] ..... H01H 1/14

[52] U.S. Cl. ..... 200/16 D; 200/86 R; 200/275; 200/333; 200/61.58 R

[58] Field of Search ..... 200/85 R, 85 A, 86 R, 200/86.5, 16 D, 5 R, 18, 153 R, 153 C, 153 D, 239, 275, 279, 333, 302, 61.58 R, 61.7

[56] References Cited

U.S. PATENT DOCUMENTS 3,553,404 1/1971 Koenig ..... 200/86 R
3,584,162 6/1971 Krakinowski ..... 200/86 R
3,717,735 2/1973 Koenig ..... 200/86 R
4,037,069 7/1977 Gonzalez ..... 200/86 R

*Primary Examiner*—Gerald P. Tolin
*Attorney, Agent, or Firm*—James P. Malone

[57] ABSTRACT

A sealable wafer switch which is normally closed in relaxed position but which opens when squeezed. A lower stiff plate. A first curved conductive member mounted on the lower plate with the curvature extending in the upward direction. An insulating plate mounted on the lower curved plate the insulating plate having a central aperture. A second curved contact member mounted on the insulating plate and having its curvature extending in the downward direction with axis perpendicular to the other curved member. The first and second conductive members being in contact through the aperture when they are in relaxed position. An upper stiff plate mounted on the second curved contact member whereby when the upper and lower stiff plates are squeezed together the contact is broken.

4 Claims, 5 Drawing Figures

NORMALLY CLOSED WAFER SWITCH

This invention relates to wafer switches. More particularly, to a wafer switch which is normally closed in relaxed position but which opens when squeezed.

BACKGROUND

Wafer switches may be used in various control applications. They respond to pressure by opening and/or closing doors, turning on and off lights, burglar alarms, detecting objects lifted, etc.

Most switches of this type are normally opened in the relaxed position but make contact when they are squeezed.

The present switch is normally closed in relaxed position but opens when squeezed. This arrangement is useful in certain control applications.

A second embodiment of the switch has a third contact plate so that the center contact makes contact with either one or the other of the end contacts depending on whether or not the switch is squeezed.

Accordingly, a principal object of the invention is to provide new and improved pressure responsive wafer switches.

Another object of the invention is to provide a new and improved wafer switch which is normally closed in a relaxed position but which opens when squeezed.

Another object of the invention is to provide new and improved wafer switches having three contacts, the center contact contacting one or ther other of the contacts depending upon whether or not the switch is squeezed.

Another object of the invention is to provide a new and improved wafer switch which is normally closed in relaxed position but which opens when squeezed comprising, a lower stiff plate, a first curved conductive member mounted on the lower plate with the curvature extending in the upward direction, an insulating plate mounted on the lower curved plate, the insulating plate having a central aperture, a second curved contact member mounted on the insulating plate and having its curvature extending in the downard direction, the first and second conductive members being in contact through the aperture when they are in relaxed position, an upper stiff plate mounted on the second curved contact member whereby when the upper and lower stiff plates are squeezed together the contact is broken. The axes of the curved members are perpendicular to each other.

These and other objects of the invention will be apparent from the following specification and drawings of which.

DESCRIPTION OF PREFERRED EMBODIMENTS

The purpose of the invention is to provide an electrical switch for sensing, signaling, controlling, etc., which will have the form of a flat wafer, which can be sealed inside a plastic envelope, and will have the following operating character:

The switch invention will provide a circuit which remains closed in relaxed condition, but will open its circuit when the flat wafer is squeezed as by placing under a foot or weight.

Its nature will be such that even with considerable heavy weight, the circuit will remain OPEN contrary to the typical expected CLOSURE from a weight.

Thickness dimension can be the order of ⅛inch.

A simple modified form of the invention gives a three wire "C" configuration with a common lead which makes with one lead and breaks from the other lead when the squeezing force is applied.

Figure 4:
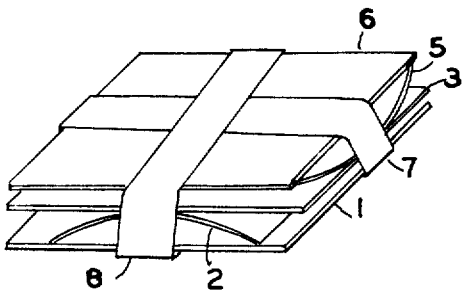
FIG. 4 is a perspective view of the switch assembly of the invention.

Referring to the drawings, the invention comprises a lower stiff plate 1, and a first curved conductive member 2 mounted on the lower plate 1. An insulating plate 3 has a central aperture 4 and rests on the contact 2. A second curved contact member 5 rests on the insulating plate 3. An upper stiff plate 6 rests on the contact member 5. The parts are bound together with insulating tapes 7 and 8, FIG. 4. Leads 14 and 15 connect to outside circuits. The axes of the curved members 2 and 5 are perpendicular to each other.

Figure 2:
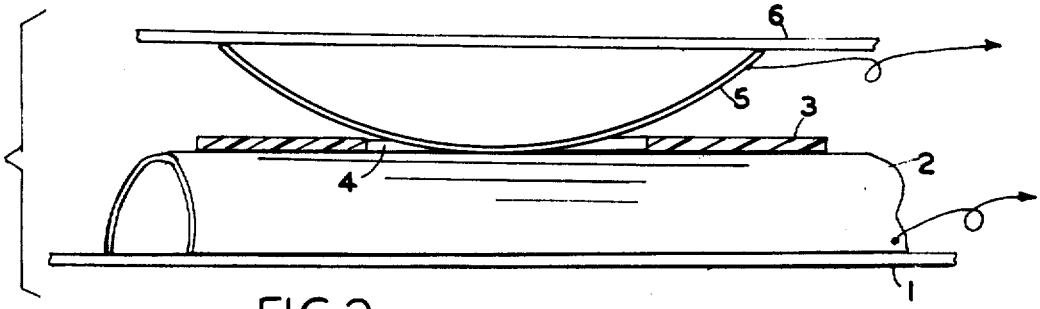
FIG. 2 is a sectional view showing the switch in relaxed, closed, position.

FIG. 2 shows the switch in relaxed position with the upper contact 5 being in contact with the lower contact 2 through the aperture 4 in the insulating plate 3.

Figure 3:
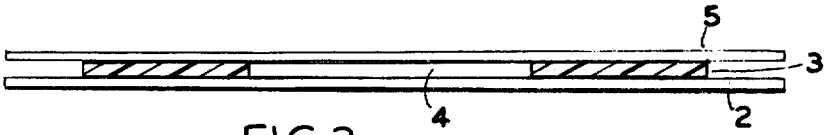
FIG. 3 is a sectional view showing the switch squeezed, open, position.

FIG. 3 shows the switch in squeezed position with the upper curved contact member 5 and lower member 2 being squeezed flat so as to break the contact between the conductive members 2 and 5. They become flat and parallel. The design is such that even with considerable weight, the circuit will remain OPEN contrary to the typical expected CLOSURE from a weight.

Figure 1:
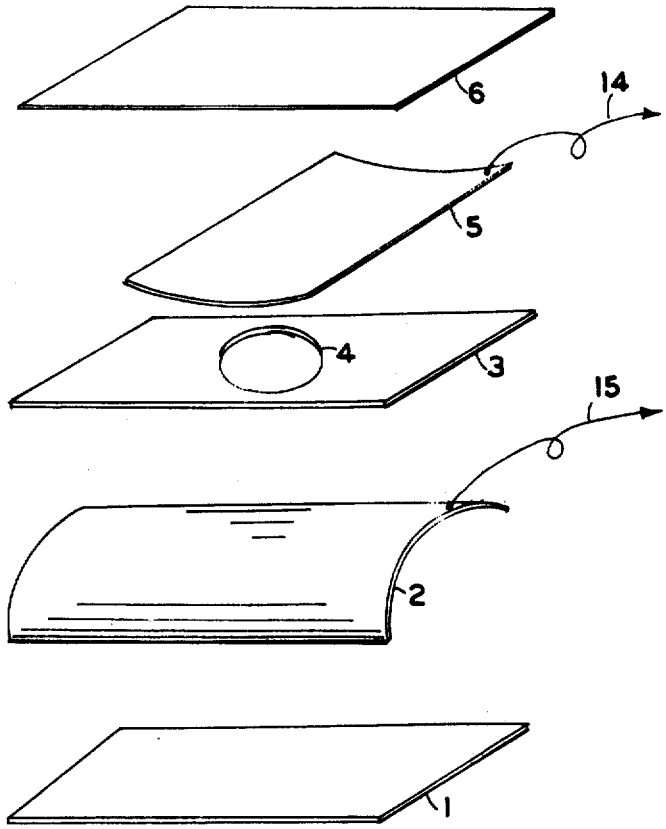
FIG. 1 is an exploded view of an embodiment of the invention.
Figure 5:
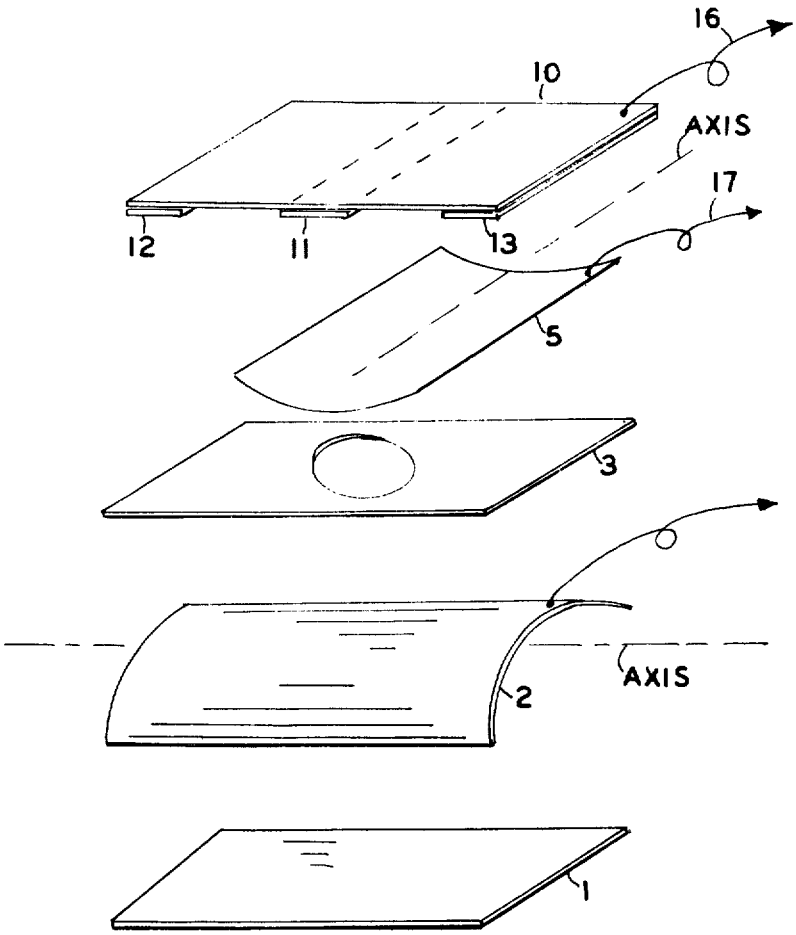
FIG. 5 is an exploded view of another embodiment of the invention having three contacts.

FIG. 5 shows another embodiment of the invention which is similar to the embodiment of FIG. 1 except that it contains an additional contact member 10 which may be a flat plate conductive member which has a conductive projection 11 mounted on the under side of its central portion. A pair of insulating strips 12 and 13 are mounted along the edges of the conductive member 10. The elements are sandwiched and taped together as in FIG. 4. When the switch is in relaxed position, the first and second curved contact members are in contact. When the switch is squeezed the upper curved member 5 will flatten out and will come in contact with the projection 11 of the conductive member 10. Therefore, one pair of contacts are made in relaxed position and the other pair of contacts are made in squeezed position. Leads 16, 17 and 18 connect to outside circuits.

The curved conductive members may be of copper clad tempered spring steel and may be about 0.005 inches thick. The dielectric plate may be of polyester sheet about 0.010 inches with the aperture 4 about ⅜inches in diameter.

The flat stiff plates 1 and 6 may be of steel about 0.020 inches in thickness. The binding tapes 7 and 8 may be of thin dielectric plastic and may be 0.003 to 0.005 inches thick.

The projecting contact 11 may be a wire affixed to the plate 10 or may be separate contacts fixed to the plate 10 or may be dimples pressed into the plate 10.

It is claimed:

1. A wafer switch which is normally closed in relaxed position but which opens when squeezed comprising:

a lower stiff plate, a first curved conductive contact member having a longitudinal axis of curvature and mounted on the lower plate with the curvature extending in the upward direction, an insulating plate mounted on the first curved conductive contact member, the insulating plate having a central aperture, a second curved conductive contact member having a longitudinal axis of curvature and mounted on the insulating plate and having its curvature extending in the downward direction, said longitudinal axes of the first and second curved contact members being at right angles to each other, the first and second conductive contact members being in contact through the aperture when they are in relaxed position, an upper stiff plate mounted on the second curved contact member whereby when the upper and lower stiff plates are squeezed together the contact is broken.

2. A normally closed wafer switch as in claim 1 having all the members bound together with insulating tape.

3. A wafer switch which is normally closed in relaxed position but which opens when squeezed comprising:

a lower stiff plate, a first curved conductive contact member mounted on the lower plate with the curvature extending in the upward direction, an insulating plate mounted on the lower curved plate, the insulating plate having a central aperture, a second curved conductive contact member mounted on the insulating plate and having its curvature extending in the downward direction, the first and second curved contact members being at right angles to each other, the first and second conductive contact members being in contact through the aperture when they are in relaxed position, a flat conductive contact member having a projection on its lower central portion, a pair of insulating strips mounted on the lower edge of the flat contact member, the insulating strips resting on the second curved contact member, whereby when the switch is in relaxed position the first and second curved contact members are in contact and when the switch is squeezed, the second curved contact member and the flat contact member are in contact, in a double through relationship.

4. A wafer switch as in claim 3 having all the members bound together with insulating tape.

* * * * *